US007129899B2

(12) United States Patent
Jecko et al.

(10) Patent No.: US 7,129,899 B2
(45) Date of Patent: Oct. 31, 2006

(54) ANTENNA

(75) Inventors: Bernard Jean Yves Jecko, Rilhac Rancon (FR); Francis Jean-Baptiste Pasquet, Peyrelevade (FR); François Louis Adrien Torres, Veyrac (FR); Cyril Nicolas Decroze, Ussac (FR)

(73) Assignee: Centre National de la Recherche Scientifique (CNRS), Paris (FR)

( * ) Notice: Subject to any disclaimer, the term of this patent is extended or adjusted under 35 U.S.C. 154(b) by 10 days.

(21) Appl. No.: 10/481,140

(22) PCT Filed: Jun. 18, 2002

(86) PCT No.: PCT/FR02/02091

§ 371 (c)(1),
(2), (4) Date: Dec. 18, 2003

(87) PCT Pub. No.: WO02/103844

PCT Pub. Date: Dec. 27, 2002

(65) Prior Publication Data

US 2004/0183735 A1 Sep. 23, 2004

(30) Foreign Application Priority Data

Jun. 18, 2001 (FR) ..... 01 07939

(51) Int. Cl.
*H01Q 1/24* (2006.01)

(52) U.S. Cl. ..... 343/702; 343/767

(58) Field of Classification Search ..... 343/702, 343/700 MS, 767, 770, 846
See application file for complete search history.

(56) References Cited

U.S. PATENT DOCUMENTS 6,300,908 B1 * 10/2001 Jecko et al. ..... 343/700 MS
6,573,869 B1 * 6/2003 Moore ..... 343/702
2001/0048391 A1 * 12/2001 Annamaa et al. .... 343/700 MS

FOREIGN PATENT DOCUMENTS

FR 2668859 A 5/1992
FR 2783115 A 3/2000

OTHER PUBLICATIONS

Kokotoff D. M. et al., "An Annular Ring Coupled to a Shorter Patch," IEEE Transactions on Antennas and Propragation, (May 1, 1997), pp. 913-914, vol. 45, No. 5, IEEE Inc., New York, USA.

* cited by examiner

*Primary Examiner*—Hoang V. Nguyen
(74) *Attorney, Agent, or Firm*—Foley & Lardner LLP

(57) ABSTRACT

The invention provides an antenna characterized in that it comprises a generator and at least two metal surfaces that are mutually parallel and substantially superposed;

at least one of the surfaces being split into at least two concentric portions constituting a central portion and a strip surrounding the central portion;

said at least two portions being interconnected by one or more conductive strips or wires;

the at least two superposed surfaces being interconnected by at least one conductive wire or strip; and the at least two portions of the split surface including a portion connected to a first terminal of the generator and a portion connected to a second terminal of the generator; this structure imparting multifunctional behavior to the antenna.

16 Claims, 12 Drawing Sheets

E θ (dB), Plane φ= 0°

E θ (dB), Azimuth plane(θ=90°)

Eφ(dB), Plane φ = 0°

E φ (dB), Azimuth plane (θ=90°)

ANTENNA

This application is a 371 of PCT/FR02/02091 filed on Jun. 18, 2002.

The present invention relates to the field of antennas.

Document FR 2 668 859 describes a single-pole wire-and-patch antenna of the type shown in FIG. 1.

Such a structure is comparable to that of a conventional printed antenna. It is constituted by a metal plate or "patch" 12 (capacitive roof of the antenna) of shape that is a priori arbitrary, placed on the top face of a dielectric slab 13. The bottom face of the slab 13 is conventionally metallized in full and constitutes the ground plane 14 of the antenna.

The antenna is fed by a coaxial probe 17. The inner conductor 15 of the probe 17 passes through the ground plane 14 without touching it and passes through the dielectric slab 13. It is connected to the metal roof 12. The outer conductor of the probe 17 is connected to the ground plane 14.

The particular feature of such an antenna is that it possesses a wire 16 making a return connection to the ground plane 14 formed by the bottom metallization. This wire 16 connects the capacitive roof 12 to the ground plane 14. It passes through the dielectric slab 13 parallel to the conductor 15 of the probe 17 and close to said conductor 15 so that this return wire 16 is inductively coupled to the wire 15 of the probe 17 and carries a current at the working frequency. The presence of this wire 16 close to the feed probe 15 is at the origin of the original operation of such an antenna.

Document FR 2 783 115 describes a coplanar wire-and-patch antenna as shown in FIG. 2. Such an antenna was developed in order to reduce overall size.

This structure has elements that are functionally comparable to those constituting the antenna described in FR 2 668 859, namely: a ground plane 14; a central capacitive "roof" 12; a feed strip 15 connected to the capacitive roof 12; and a ground return strip 16 which connects the capacitive roof 12 to the ground plane 14 (by analogy with the respective above-mentioned feed and return wires). However, with the coplanar wire-and-patch antenna shown in FIG. 2, the capacitive roof 12 and the ground plane 14 lie in the same plane, the ground plane 14 being at the periphery of the antenna, around the capacitive roof 12.

The principle of operation of those prior art antennas relies mainly on a complex coupling phenomenon between the feed probe 15 (or feed strip) and the wire 16 (or ground strip). Without the ground return, such antennas behave like series resonant circuits due to the inductance of the feed probe 15 ($L_{feed}$) and to the capacitance ($C_{roof}$) formed between the capacitive roof 12 and the ground plane 14. Adding a ground return 16 between the roof 12 and the ground plane 14 creates induction ($L_{ground}$) parallel with the capacitance ($C_{roof}$) giving rise to the appearance of parallel resonance.

A simplified equivalent diagram of these antennas is shown in FIG. 3. By an appropriate selection of the various physical parameters, it is possible to match such antennas to conventional microwave generators.

In each of those prior art cases, the operating mode of the antennas is characterized by a high concentration of current in the return wire (or strip) 16, thus imparting to those structures radiation of the single-pole type for the wire-and-patch antenna and of the dipolar type for the coplanar wire-and-patch antenna.

The present invention seeks to improve previously-proposed structures both in terms of operating effectiveness, in particular ways of matching the antenna and a generator, and in terms of overall size.

To achieve these objects, the invention provides an antenna comprising a generator and at least two metal surfaces that are mutually parallel and substantially superposed;

- at least one of the surfaces being split into at least two concentric portions constituting a central portion and a strip surrounding the central portion;
- said at least two portions being interconnected by one or more conductive strips or wires;
- the at least two superposed surfaces being interconnected by at least one conductive wire or strip; and
- the at least two portions of the split surface including a portion connected to a first terminal of the generator and a portion connected to a second terminal of the generator; this structure imparting multifunctional behavior to the antenna.

The antenna formed in this way in accordance with the present invention combines a plurality of radiating elements each capable of operating in transmission or in reception at its natural mode at frequencies that are different and independent, without increasing the overall volume of the antenna compared with dispositions known in the prior art. The present invention thus makes it possible to obtain an antenna of relatively small size compared with its working wavelength(s).

Advantageously, according to other characteristics of the present invention:

- the surfaces split into two elements together provide a mode of operation of the wire-and-patch antenna type formed by the two metal surfaces taken together;
- each surface split into two elements interconnected by at least one conductive strip or wire adds a new mode of operation of the coplanar wire-and-patch antenna type formed by the two separated portions;
- the antenna includes an electrical feed connection connecting the first terminal of the generator/receiver to the central portion of the surface split into at least two portions, which electrical connection is formed by a wire extending perpendicularly to the two surfaces;
- the electrical feed connection is formed by the central conductor of a coaxial connection which passes through the other metal surface without touching it;
- the electrical feed connection is connected to a strip connected to a central portion of the surface that is split into at least two portions;
- the electrical feed connection is formed by a wire which connects the central portion of the split surface to the other surface;
- the electrical feed connection is formed by a vertical wire which connects a feed strip of the central portion of the split surface to the other surface;
- the conductive wire or strip connects the outer zone of the split surface to the other surface;
- the wire connects the other surface to the outer zone of the second split surface;
- the wire or strip connects the surface to a strip providing the connection between the two portions of the split surface;
- the antenna comprises:
  - a coplanar feed line formed by three parallel strips, the central strip being connected to the active terminal of a generator/receiver while the two outer strips are connected to the ground of the generator/receiver, the central strip is connected to the central element and passes through the peripheral element without touching it, the two outer elements of the coplanar line being connected to the peripheral element, in which case feed is performed via a coplanar line made up of three parallel strips, the central strip being connected to the central element of the bottom plane and the two outer strips of said line are connected to the peripheral element;

a first conductive connection which connects the feed strip to the central element; and a second conductive connection which connects the peripheral element to the surface;

the antenna includes a plurality of mutually parallel top plates of identical shape;

the antenna includes a plurality of top plates each split into a central element and a strip peripheral to the central element and interconnected by a ground return strip or connection, the central elements of the various plates being interconnected by wires extending a free wire, while the various peripheral strips are interconnected by wires extending a ground return wire;

the antenna includes a plurality of solid parallel top plates interconnected by at least one wire, and preferably via multiple connections disposed in a symmetrical arrangement; and the antenna comprises three surfaces arranged in series between two terminals of a generator/receiver.

Other characteristics, objects, and advantages of the invention appear on reading the following detailed description made with reference to the accompanying figures, in which.

Figure 8:
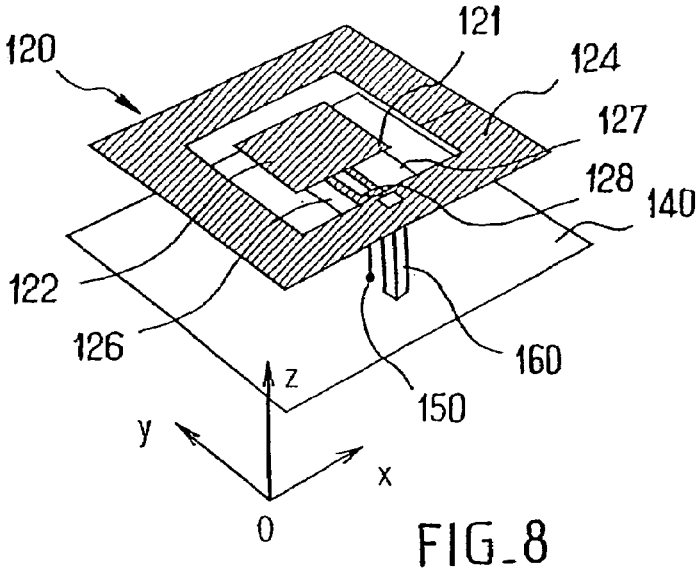
FIG. 8 is a perspective view of the same antenna.
Figure 8A:
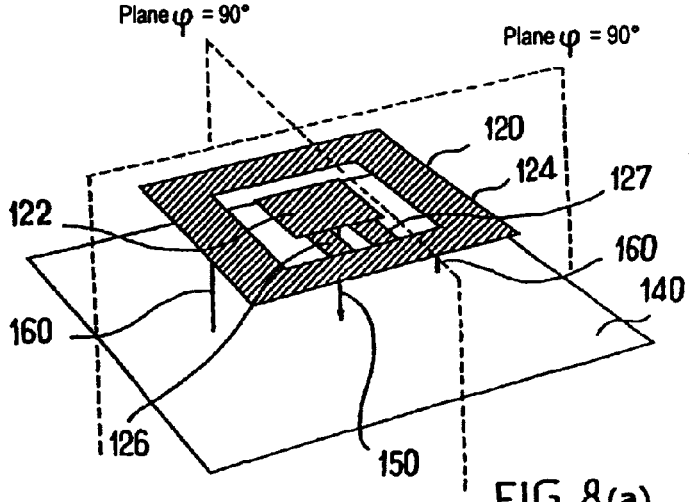
Figure 8B:
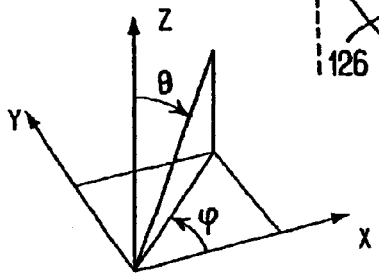
Figure 8C:
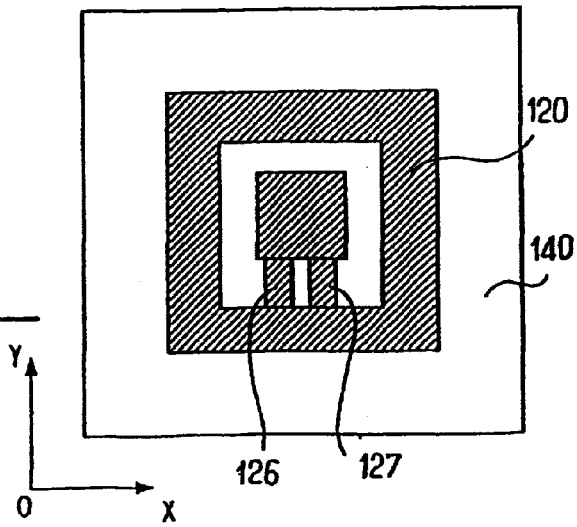
Figure 8D:
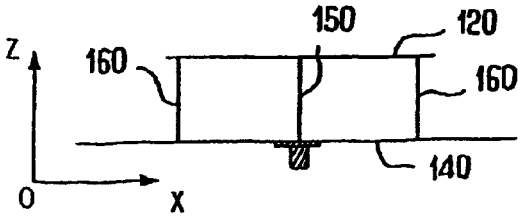
Figure 9:
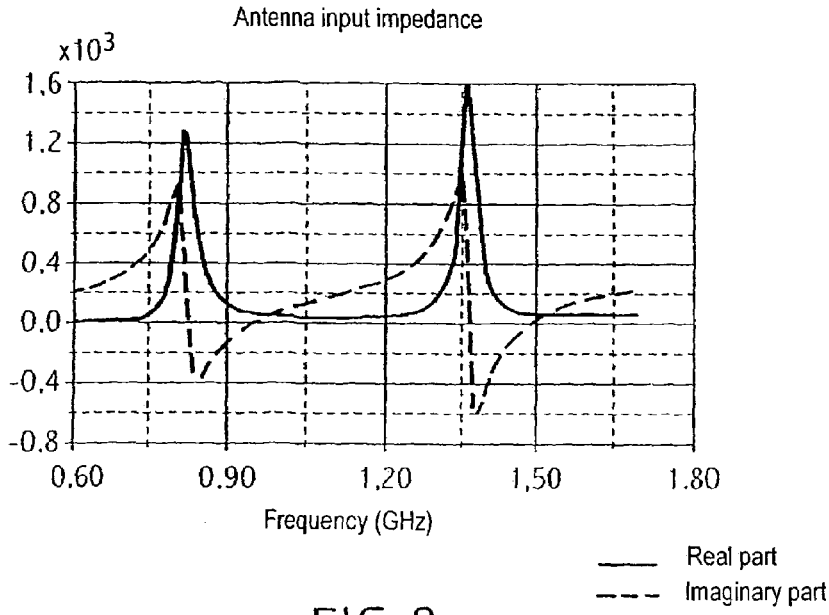
Figure 10:
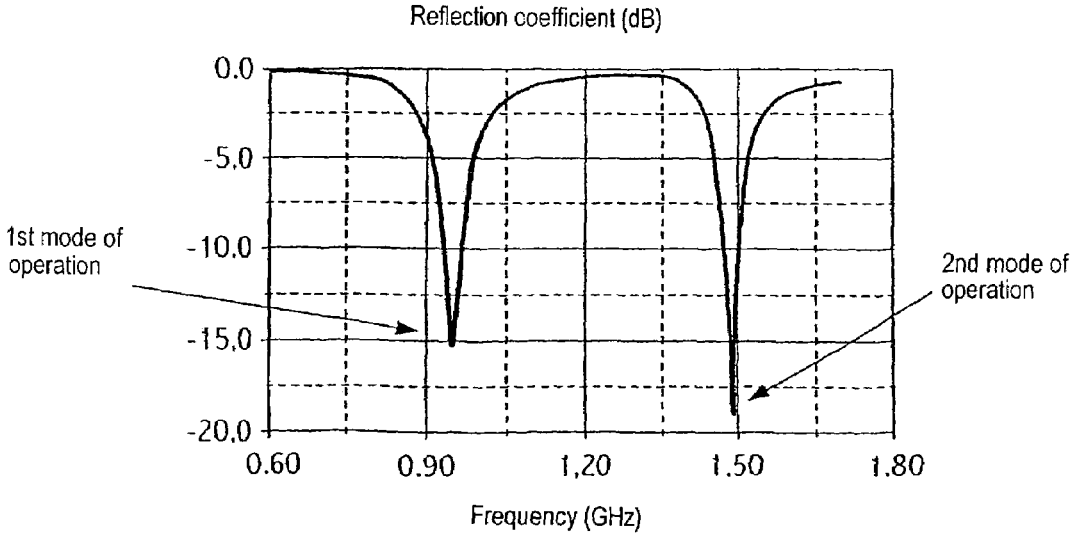
Figure 11:
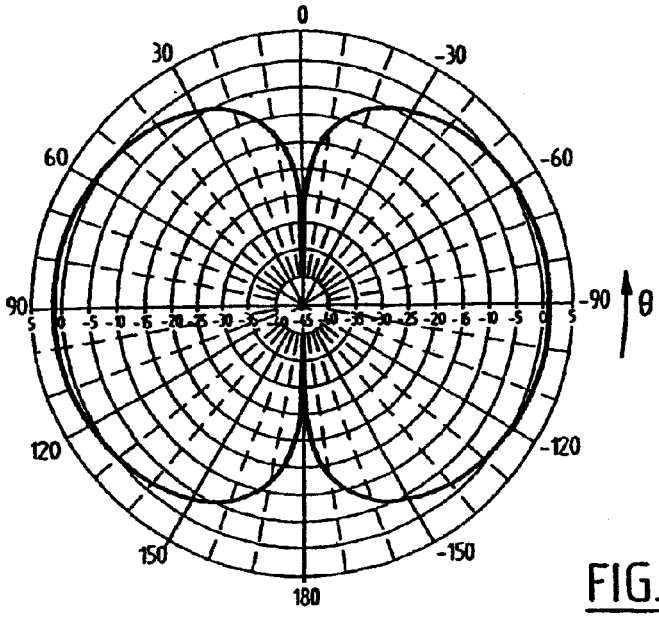
Figure 11A:
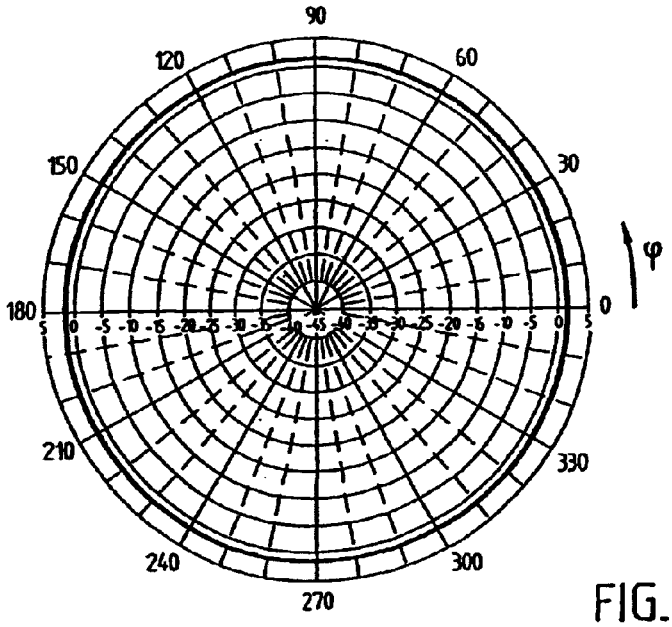
Figure 12:
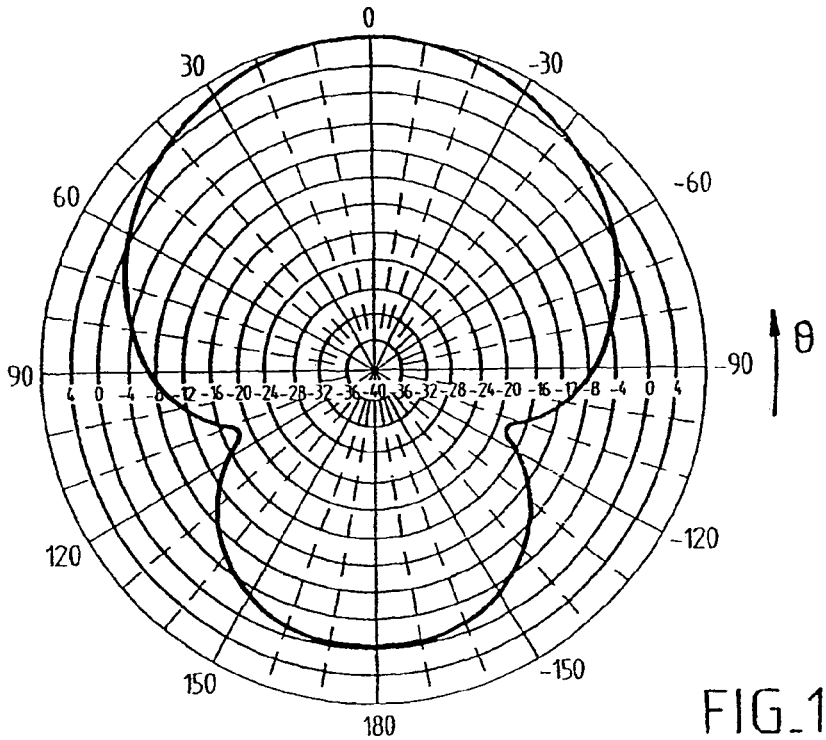
Figure 13:
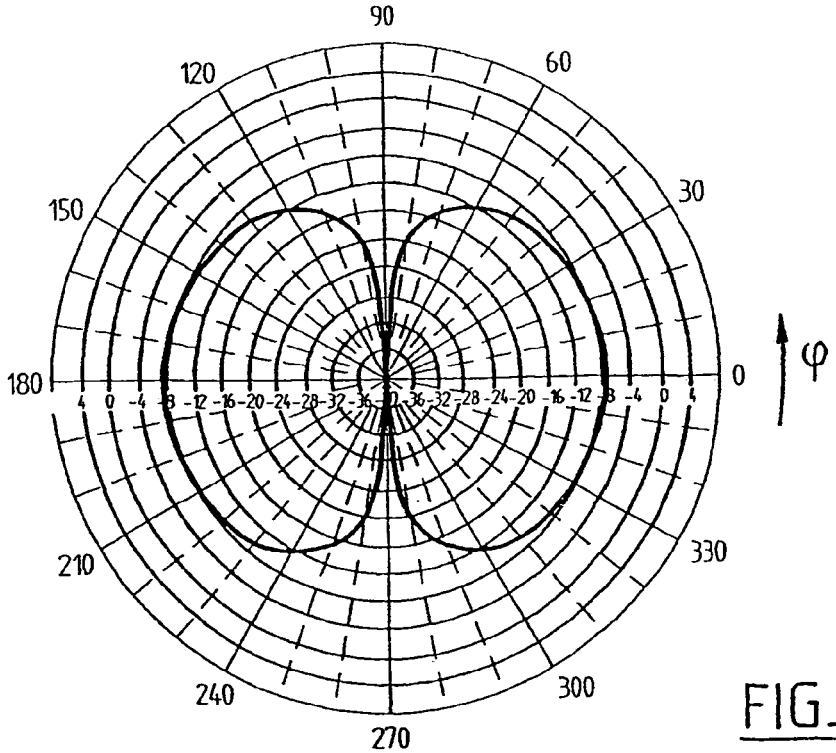
Figure 14:
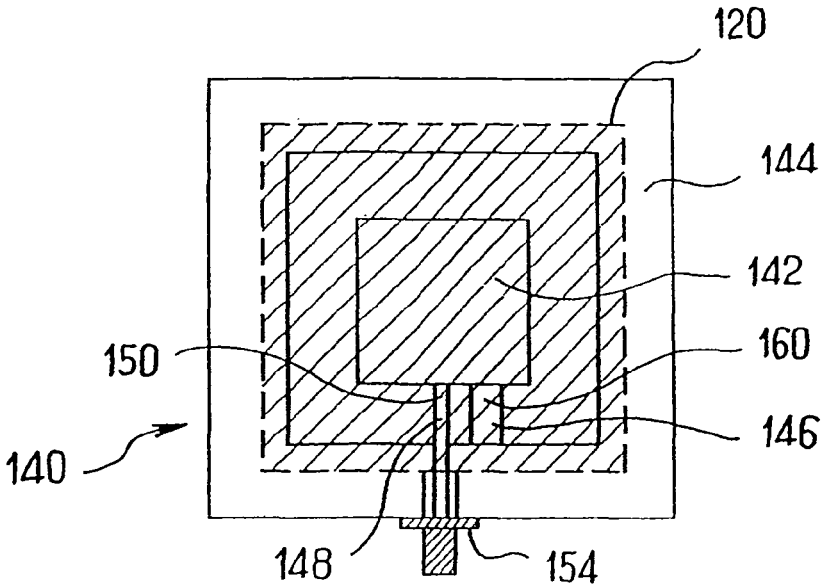
Figure 15:
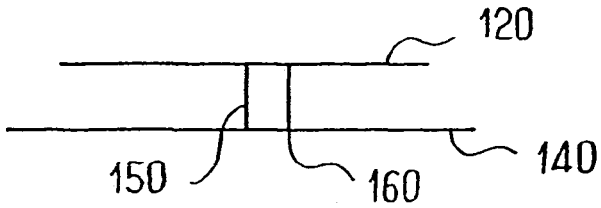
Figure 16:
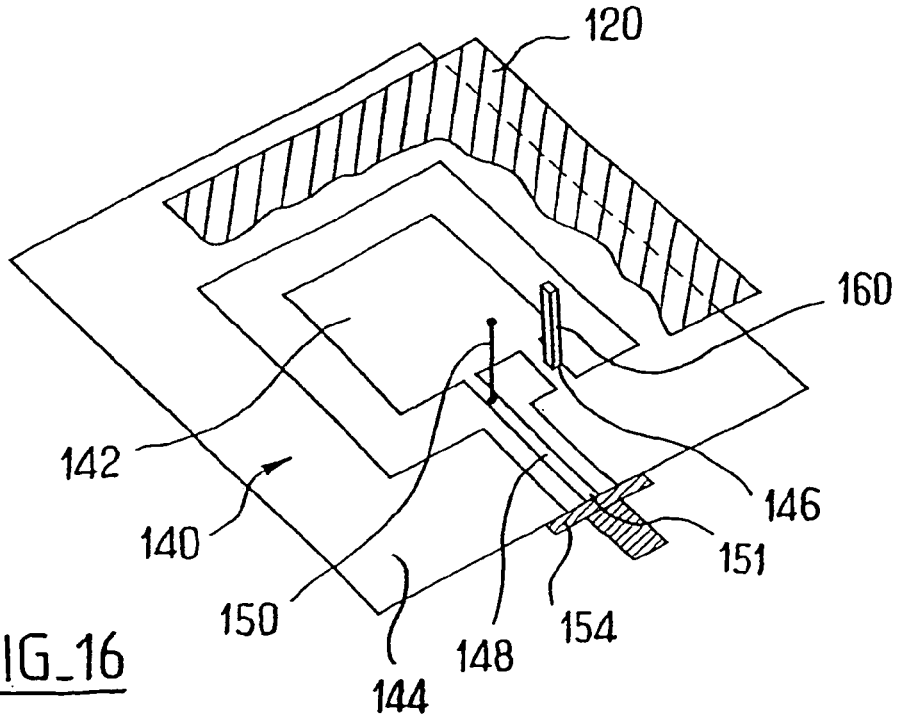
Figure 17:
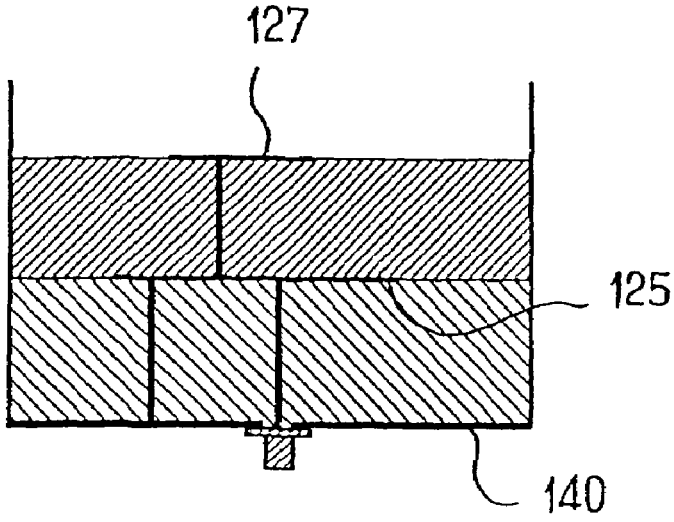
Figure 18:
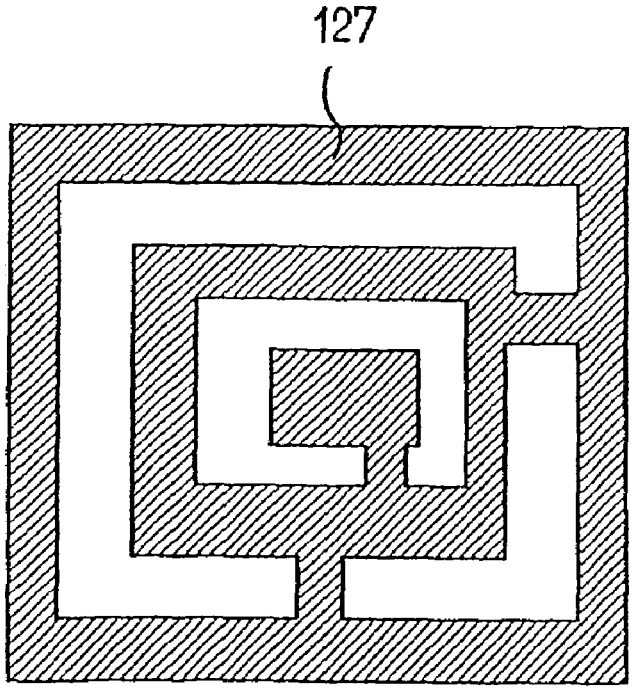
Figure 19:
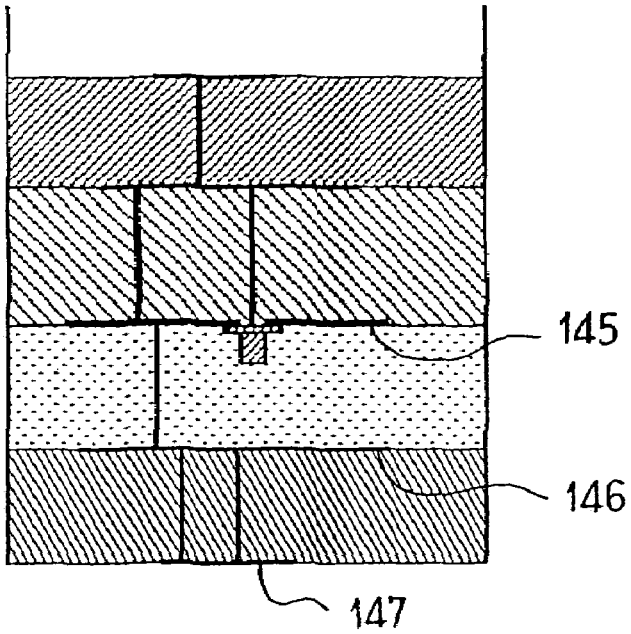
Figure 20:
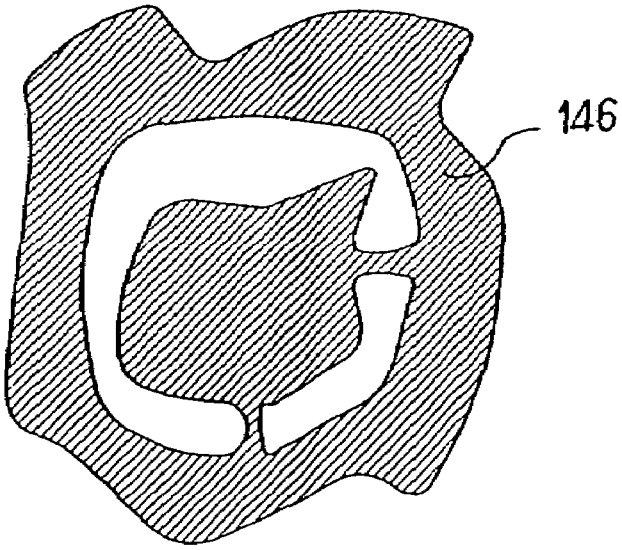
Figure 21:
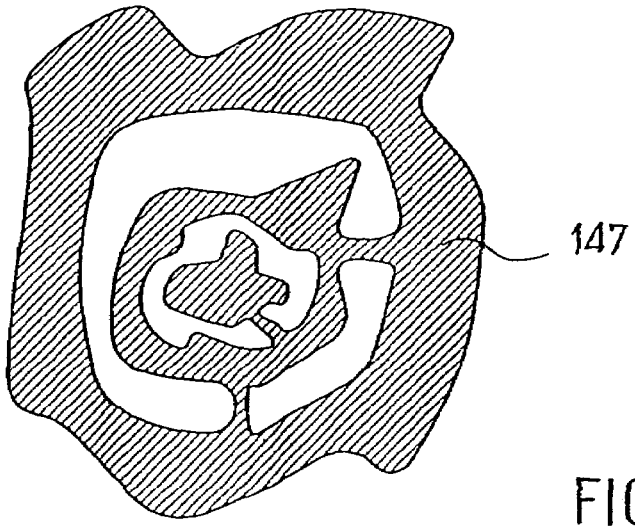
Figure 22:
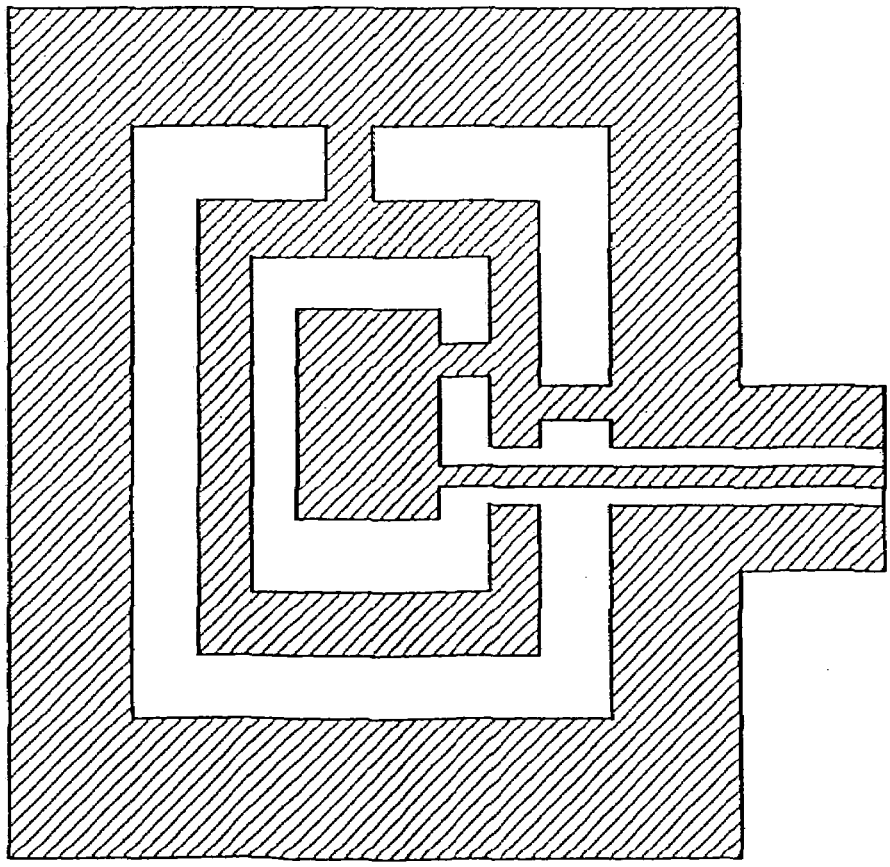
Figure 23:
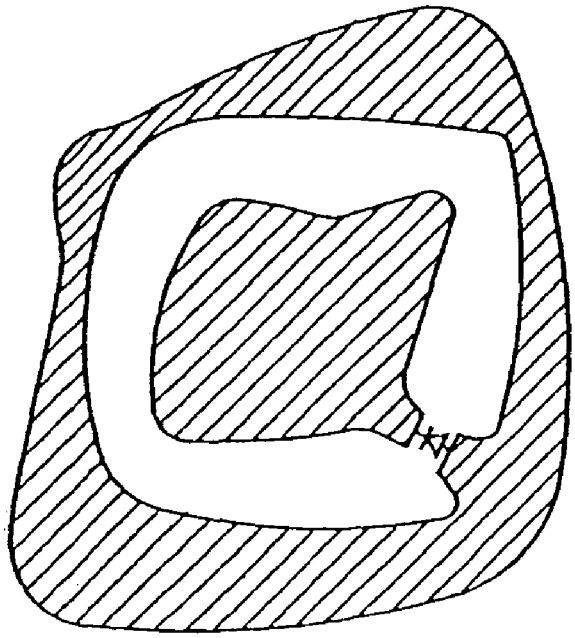
Figure 24:
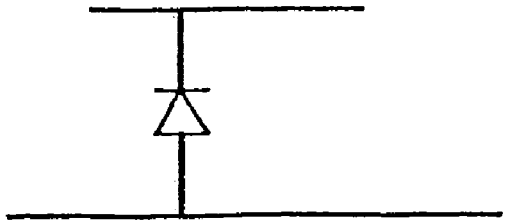

FIGS. 8(*a*) to 8(*d*) show an antenna of type close to that of FIG. 8, still in accordance with the invention;

FIGS. 9 and 10 plot input impedance and frequency matching (reflection coefficients) for the antenna of FIGS. 8(*a*) to 8(*d*);

FIGS. 11 and 11(*a*) are plots of radiation patterns achieved for a main polarization (vertical) in a vertical section plane (FIG. 11), and a horizontal section plane (FIG. 11(*a*) for a first operating mode at 0.94 gigahertz (GHz);

FIGS. 12 and 13 are radiation patterns respectively for a vertical section plane XOZ and an azimuth section plane XOY for the main polarization (horizontal) in a second mode of operation at 1.49 GHz of the antenna of FIG. 8(*a*) to 8(*d*);

FIG. 14 is a plan view of an antenna in a second embodiment of the invention;

FIG. 15 is a side view of the same antenna;

FIG. 16 is a perspective view of said antenna in accordance with the invention;

FIG. 17 is a section view of an antenna in another embodiment of the invention;

FIG. 18 is a plan view of a metal surface of the antenna of FIG. 17;

FIG. 19 is a section view of an antenna of another embodiment of the invention;

FIG. 20 is a plan view of a metal surface of the antenna of FIG. 19;

FIG. 21 is a plan view of another metal surface of the FIG. 19 antenna;

FIG. 22 is a plan view of a metal surface of an antenna of another embodiment of the invention;

FIG. 23 is a plan view of a metal surface of an antenna of another embodiment of the invention, having diodes; and FIG. 24 is a cross-section of another embodiment of an antenna including a diode between two superposed surfaces.

Like a conventional wire-and-patch antenna, the antenna of the first embodiment (FIGS. 4 to 6) comprises two parallel plates in the form of a plate 140 that is grounded and a plate 120 that is both fed with current via a probe 150 and connected to ground via a connection 160 returning to the ground plane 140, which connection 160 is inductively coupled to the wire of the probe 150 so as to carry current at a working frequency.

However, in the context of the present invention, the plate 120 is split into two elements 122 and 124: a central surface 122 and a peripheral strip 124 which surrounds the central surface 122 at a distance therefrom.

The central surface 122 and the strip 124 are separated from each other by a gap 123 that is circumferential about the central surface 122.

In addition, the central surface 122 and the strip 124 are interconnected by a connection 126 which is coplanar therewith.

The shapes of the central surface 122, of the strip 124, and of the bottom plate 140 are not critical.

However, the central surface 122, the strip 124, and the bottom plate 140 preferably have outlines of the same shape, for example rectangular, square, circular, oval, etc. . . . . The top plate 120 is advantageously centered on the bottom plate 140. The top plate 120 is also advantageously smaller in area than the bottom plate 140.

The strip 126 preferably also extends in a direction that is generally radial relative to the center of the central surface 122.

Figure 1:
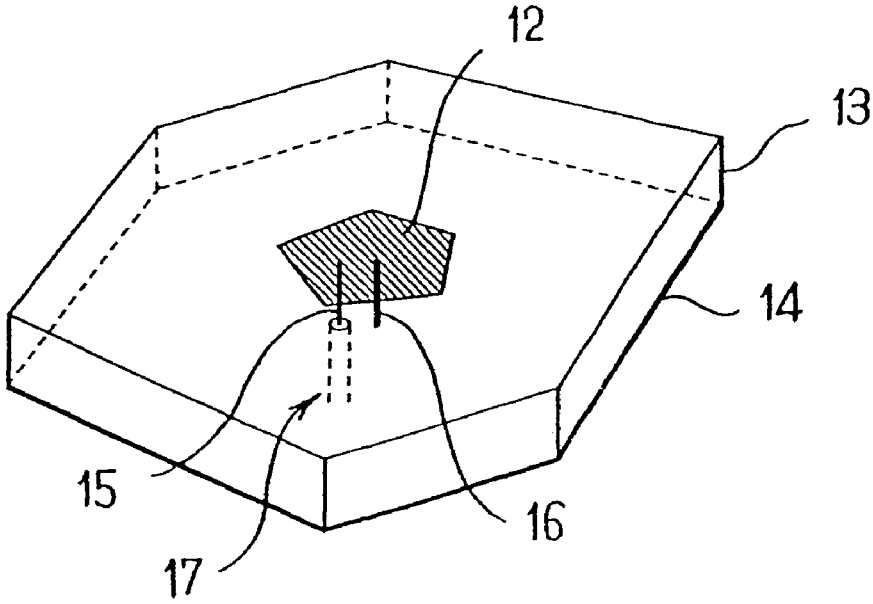
FIG. 1 shows a single-pole wire-and-patch antenna of the prior art.
Figure 2:
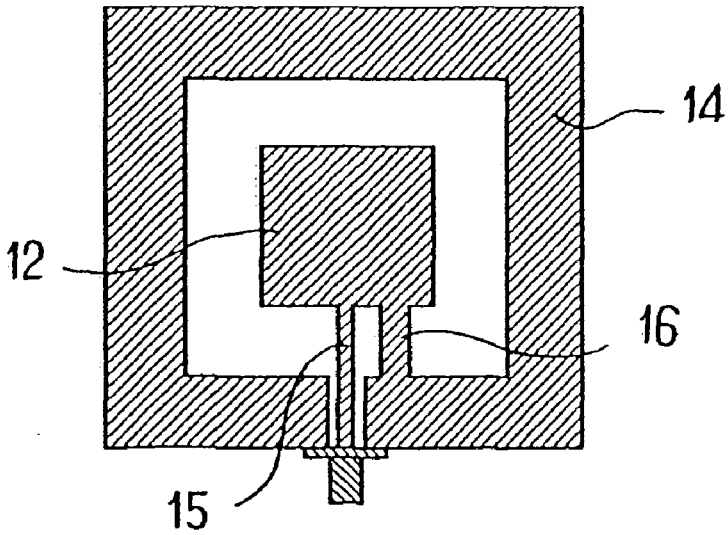
FIG. 2 shows a coplanar wire-and-patch antenna of the prior art.
Figure 3:
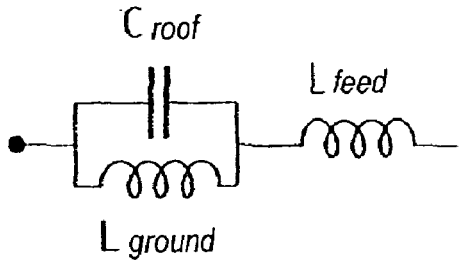
FIG. 3 is a simplified circuit diagram illustrating the electrical behavior of the antennas of FIGS. 1 and 2.
Figure 4:
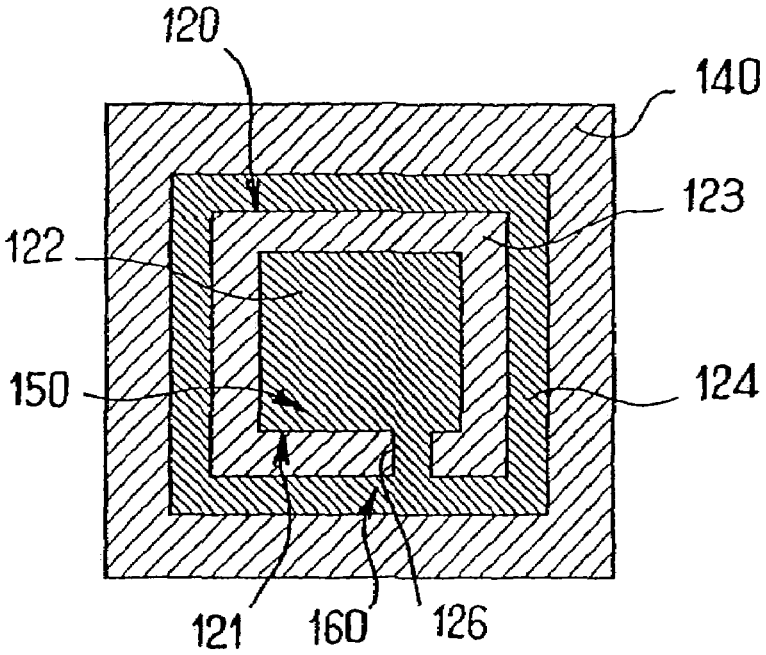
FIG. 4 is a plan view of an antenna constituting a first embodiment of the invention.
Figure 5:
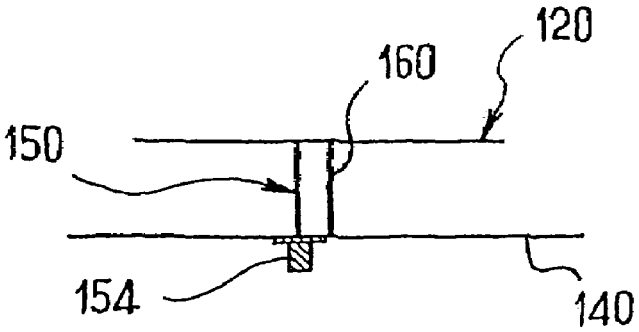
FIG. 5 is a side view of the same antenna.
Figure 6:
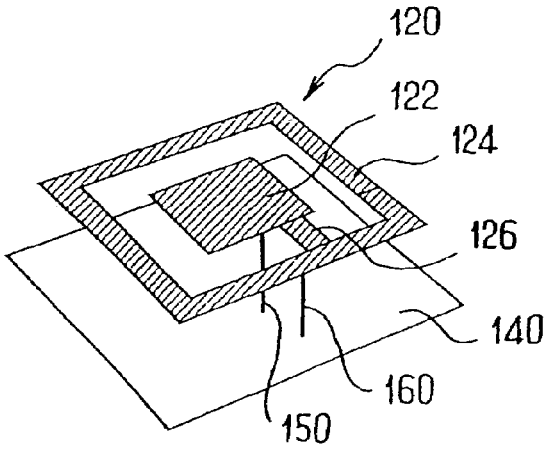
FIG. 6 is a perspective view of the same antenna.

More precisely, in the embodiment shown in FIGS. 4 to 6, the central surface 122 is square in shape, while the strip 124 comprises four segments that are respectively parallel and perpendicular to one another and to the edges of the central surface 122, in pairs. The connection 126 is perpendicular to an edge 121 of the central surface 122 and to one of the segments making up the strip 124.

As shown in accompanying FIGS. 4 to 6, the antenna comprises:

a ground plane 140;

a top plane 120 split into two concentric elements 122 and 124 interconnected by a coplanar connection 126 and constituting simultaneously a capacitive roof constituted by its central element 122, and a ground element constituted by its peripheral element 124;

a coaxial probe whose outer shield 154 is connected to the ground of a generator/receiver, while its central conductor 150 is connected to the active terminal of the generator/receiver, the shield 154 of the probe being connected to the ground plane 140 while the central conductor 150 passes through the ground plane 140 without touching it and is connected to the central element 122 of the top plane 120; and a conductive connection 160 coupled inductively with the central conductor of the probe 150, and connecting the peripheral element 124 of the top plane to the ground plane 140.

The conductive connection 160 serves simultaneously to interconnect the ground elements 124 and 140, and to provide the ground return for the wire-and-patch antenna.

In the particular embodiment shown in accompanying FIGS. 4 to 6, the feed conductor 150 of the probe is placed perpendicularly to the two planes 120 and 140 close to one of the edges 121 of the central element 122. The conductive connection 160 is placed parallel to the conductor 150 on an edge of the outer strip 124 placed facing the above-mentioned edge 121.

Figure 7:
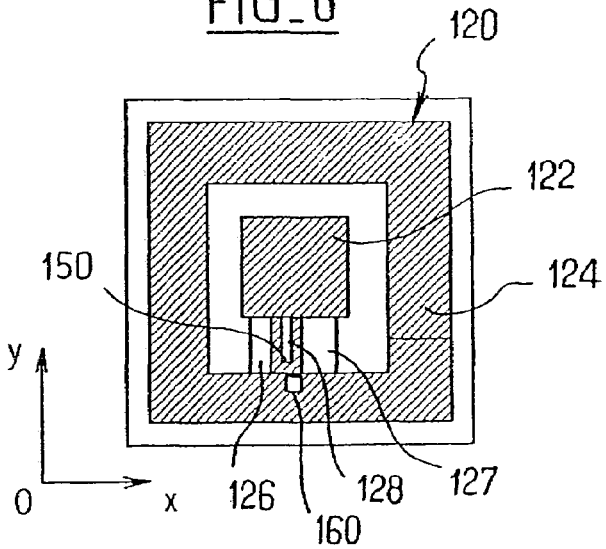
FIG. 7 is a plan view of an antenna constituting a variant of the invention, used for simulating the behavior described below.

FIGS. 7 and 8 show an antenna of this kind comprising:

a bottom ground plane 140;

a top plane 120 split into two concentric elements 122 and 124 that are interconnected and constitute simultaneously a capacitive roof in the form of the central element 122 and a ground element in the form of the peripheral element 124;

a coaxial probe whose outer shield 154 is connected to the ground of a generator/receiver, while its central conductor 150 is connected to the active terminal of the generator/receiver, the shield 154 of the probe being connected to the ground plane 140 while its central conductor 150 passes through the ground plane 140 without touching it and is connected to the central element 122 of the top plane 120; and a conductive connection 160 coupled inductively to the central conductor of the probe 150, and connecting the peripheral element 124 of the top plane to the ground plane 140. The size of the bottom plane 140 is 70 millimeters (mm)×70 mm, and the size of the top plane 120 is 60 mm×60 mm, while the height is 7 mm. This antenna possesses a vertical feed wire 150.

In this variant, the central element 122 is connected to the peripheral element 124 by two connections 126 and 127 instead of by a single connection. These two connections are parallel to each other, perpendicular to an edge 121 of the central element 122 and connected to said edge, about one-fourth of the way along said edge 121 measured respectively from its first end and from its second end.

In addition, the feed wire 150 is not directly connected to the central surface 122 but to an additional strip 128 which extends outwards from the central surface 122 towards the peripheral strip 124 but which does not meet the peripheral strip 124. The feed conductor 150 which extends perpendicularly to the planes 120 and 140 is placed at the end of this strip 128. Under such circumstances, feed is offset by said horizontal strip 128 which is offset in order to optimize antenna matching.

The ground return wire 160 is placed at the edge of the outer strip 124 placed facing the edge 121 of the central surface 122, substantially between the feed strip 128 and the ground return strip 127.

As shown in FIGS. 7 and 8, the strips 126 and 127 may be of different widths.

It should thus be observed that the presence of two return strips 126 and 127, and the slight offset of the feed wire 150 via the strip 128 serve to optimize the input impedance characteristics so as to improve antenna matching.

Thus, not only does such an antenna transform the energy received in a matched band into energy that is radiated in a given direction with privileged polarization, but it also enables matching to be performed with a generator having given input impedance (generally 50 ohms (Ω)) in one or more frequency bands.

The geometrical parameters of the antenna may differ depending on user requirements (operating frequencies, matching, passband, . . . ) and can easily be developed by the person skilled in the art as a function of matching to the desired frequencies.

The antenna of FIGS. 8(*a*) to 8(*d*) constitutes another variant having two ground return strips 160.

FIGS. 8(*a*) to 8(*d*) show the shape of the antenna, the size of its bottom plane 140 is 100 mm×100 mm, the size of its top plane 120 is 60 mm×60 mm, and its height is 22 mm. This antenna possesses two connection strips 160 and a vertical feed wire 150.

The results shown in FIGS. 9 and 10 reveal two parallel resonances at 0.83 GHz and 1.37 GHz in the input impedance. The first resonance corresponds to the wire-and-patch antenna mode and the second resonance corresponds to the coplanar wire-and-patch antenna mode as cut out in the surface 120. For each of the modes, matching occurs when the real portion of the input impedance is close to 50 ohms and the imaginary portion is close to 0. Matching for the first mode is thus −15 decibels (dB) and takes place at 0.94 GHz, and matching for the second mode is −18 dB at 1.49 GHz.

The gain charts (FIGS. 11 to 13) are shown in two section planes for each mode of operation (note: only the main polarization of the electric field is plotted, E0 for the first mode and Eϕ for the second).

The first mode (at 0.94 GHz) presents a pattern (FIGS. 11 and 11(*a*) that is circularly symmetrical about the axis OZ (omnidirectional in azimuth with maximum gain to the horizon).

The second mode (FIGS. 12 and 13) presents hemispherical coverage with maximum gain on the axis of the antenna.

A second embodiment of the invention is shown in FIGS. 14, 15, and 16.

These figures show an antenna which is generally in the form of a wire-and-patch antenna, i.e. which presents two parallel main metal planes 120 and 140.

However, in this case it is the bottom metal plane 140 forming the ground plane of the assembly that is split into two elements, a central element 140 connected to the first active terminal of the generator/receiver via a strip 140, and a peripheral element 144 connected to the second terminal, ground, of the generator/receiver.

Thus, the metal plate 140 presents a peripheral strip 144 which is connected to ground while its central surface 142 is connected to the positive terminal of a current source.

These two elements 142 and 144 are interconnected by a ground return strip 146 which is coplanar therewith.

The shapes of the top plate 120, of the central surface 142, and of the strip 144 are not critical.

However, the top plate 120 is preferably centered on the bottom plate 140. In addition, the central surface 142 and the strip 144 have outlines of the same shape, e.g. rectangular, square, circular, oval, etc. . . . .

The top plate 120 also advantageously has an area that is smaller than that of the bottom plate 140.

The strip 146 preferably extends in a direction that is generally radial relative to the center of the central surface 142.

Still more precisely, in the embodiment shown in FIGS. 14 to 16, the central surface 142 is square in shape, while the strip 144 comprises four segments (one of which is split into two aligned portions so as to leave a gap for the feed strip 148) that are respectively parallel and perpendicular to one another and to the edges of the central surface 142 in pairs. The connection 146 is perpendicular to one of the edges of the central surface 142 and to one of the segments making up the strip 144. It is parallel and coplanar with the feed strip 148.

The top plate 120 is connected to the central surface 142 of the plate 140 so that it too is fed.

For this purpose, a feed connection 150 constituted by a single wire connects the central surface 142 to the plate 120.

More precisely, the peripheral strip 144 is generally C-shaped. The central surface 142 is extended by a coplanar track forming the feed strip 148 which leads to the outside via the gap in the C-shape. The wire connection 150 which extends perpendicularly to the planes of the plates 120 and 140 connect the feed strip 148 to the plate 120.

A ground return wire 160 also interconnects the two plates 120 and 140. This ground return wire connects the plate 120 to the plate 140 via its ground return strip 146 between the central surface 142 and the peripheral strip 144. The ground return wire 160 extends perpendicularly to the planes 120 and 140.

Thus, the antenna shown in accompanying FIGS. 14 to 16 comprises:

- a ground plane 140 split into two concentric elements 142 and 144 that are interconnected by a connection 146;
- a top plane 120;
- a coaxial probe whose outer shield 154 is connected to the ground of a generator/receiver, while its central conductor 150 is connected to the active terminal of the generator/receiver, the shield 154 of the probe being connected to the strip 144 while the central conductor 151 is connected to the central element 142 of the bottom plane 140 via a feed strip 148;
- a conductive connection 150 which connects the feed strip 148 to the top plate 120 close to the central element 142; and
- a conductive connection 160 coupled inductively to the conductor 150 and connecting the top plane 120 to the perpendicular element 144 of the bottom plane 140 (and more precisely its strip 146).

In FIG. 14, the return wire connects the plate 120 to the plate 140 via its ground strip. In general, the return wire connects the plate 120 to the peripheral element 144 of the plate 140.

The capacitive roof of this general structure is thus formed by the plate 120 which behaves as the capacitive roof of a traditional wire-and-patch antenna in the sense that it is fed with current and it is connected to a parallel ground plane, in this case the plate 140, and more precisely the strip 144 thereof.

In the present case, the assembly is fed by the strip 148 and the wire 150.

It should be observed that the ground return wire 160 interconnecting the two plates 120 and 140 joins the bottom plate 140 via its ground return strip 146.

In the context of the present invention, and regardless of which embodiment, it is emphasized that it is important for the ground return wire 160 to be close to the feed wire 150 so as to be capable of being inductively coupled thereto so that the ground return wire 160 carries current at the working frequency. Typically the spacing between the feed wire 150 and the ground return wire is less than $\lambda/10$, where $\lambda$ represents the working wavelength.

The multifunctional radiating devices described above constitute only some examples out of the many possibilities that can be envisaged, the geometrical shapes of the various elements being open to variation depending on the functions to be performed or the working frequency.

On average, the size of the side of the surface 120 is $\lambda/6$ for the first mode of operation and $\lambda/4$ for the second mode.

The small size (on average $\lambda_0/4$) of these antennas in volume terms makes them easy to integrate in present communications systems. In addition, this size can be reduced even further by using a dielectric substrate.

The present invention can thus be considered for various modes of operation depending on its geometrical configuration.

By way of example, the following can be mentioned: application to a multilobe antenna (privileging various directions of radiation) at the same frequency (e.g. for telemetry applications).

It is also possible to envisage a multifunction antenna, e.g. an antenna combining GSM, GPS, . . . functions.

Such antennas also enable aerials to be miniaturized in mobile communications systems.

The plates 120 and 140 may be supported in their relative positions by any appropriate means. The plates 120 and 140 are thus preferably disposed on respective opposite sides of a dielectric substrate of thickness that is small compared with the dimensions of the plates 120 and 140. The substrate may be constituted by a uniform layer. However, it can be appropriate for the substrate to be built up as a plurality of adjacent layers having different dielectric properties stacked on one another. In a variant, the dielectric medium placed between the two plates 120 and 140 may even be constituted by air.

The plates 120 and 140 are thus preferably made by etching metallization formed on opposite faces of a substrate, or by depositing controlled outlines on the substrate.

Naturally, the present invention is not limited to the particular embodiments described above, but extends to any variant embodiment within the spirit of the invention.

Thus, by way of example, the antenna of the present invention may comprise a plurality of top plates 120 that are parallel to one another and of identical shape, both in the context of the first embodiment and in the context of the second embodiment.

In the context of the first embodiment, each of the various plates 120 may comprise a central element 122 and an outer strip 124 interconnected by a ground return strip 126. The central elements 122 of the various plates 120 may be interconnected by wires extending the feed wire 150, while the various outer strips 124 may be interconnected by wires extending the ground return wire 160.

In the context of the second embodiment, the various plates 120 can be solid. These plates 120 are interconnected by wires comparable to the wire 150. However, under such circumstances, the connections that exist between two adjacent plates 120 are preferably formed by multiple connections disposed in a symmetrical arrangement.

In yet another variant, the antenna of the present invention may be associated with a near-by reflector so as to shape the radiation, e.g. so as to concentrate radiation in a desired direction.

Other embodiments of the invention are shown in FIGS. 17 to 24. The configuration of FIG. 17 has a top level constituted by two parallel conductive surfaces interconnected by at least one vertical conductor (referred to as the "ground" return wire or strip).

This top layer of reference 120 comprises two plates 125 and 127. The plate 125, the lower plate of the top level, is shown in plan view in FIG. 18. It is subdivided into three concentric elements interconnected by conductive strips (or wires in a variant).

Each cutout gives rise to a second type of operation delivering axial radiation (maximum gain on the axis of the antenna). The smaller the cutout metal portion, the higher the resonant frequency of the second type of operation.

Each level gives rise to a mode of operation of the wire-and-patch antenna type: input impedance presenting parallel resonance at a given frequency, and radiating in circularly symmetrical manner about the vertical axis (omnidirectional) and presenting maximum gain to the horizon.

FIG. 19 shows yet another embodiment of the invention. In this embodiment, the bottom level comprises three metal surfaces 145, 146, and 147, with the levels 146 and 147 being shown in plan view respectively in FIGS. 20 and 21. The three metal surfaces of this lower level are interconnected by at least one conductive wire.

As can be seen in FIG. 20, the plate 146 presents two concentric elements interconnected by two strips, and as can be seen in FIG. 21, the plate 147 presents three concentric surfaces, with the outer two concentric surfaces being interconnected by two strips. The inner concentric surface is connected to the intermediate concentric surface by a single strip.

It should be observed that in general an arbitrary number of concentric elements can be adopted in a given conductive surface, while connecting two of these concentric elements to a different terminal of a generator.

In FIGS. 20 and 21, the various concentric elements are not circularly symmetrical, constituting an embodiment in which the surfaces are selected in a manner that is specifically adapted as a function of the intended application.

Two types of excitation can be envisaged, as in the other embodiments of the invention:

The first type of excitation (FIG. 17) is performed by a vertical feed wire between two surfaces. The vertical feed wire may pass through a plurality of levels and be connected to the central element in each level. This wire constitutes the central core of a coaxial waveguide connected to one of the two above-mentioned surfaces and passes through the second surface without touching it. This surface is then connected to the outer shield of the coaxial waveguide (the other levels are then fed by coupling).

In the context of the first excitation, the outer shield of the coaxial waveguide can constitute the above-mentioned vertical ground return wire.

The second type of excitation takes place in the plane of one of the surfaces via a coplanar line, this surface possibly having three concentric elements as shown in FIG. 22 where, in FIG. 22, it is the innermost concentric element which is connected to a first terminal of the generator, while it is the outermost concentric element that is connected to the second terminal of the generator, with the intermediate concentric element being connected to the generator only via one or other of the inner or outer concentric elements.

In the second type of excitation, it is preferable to interconnect the inner elements of the various surfaces by a vertical connection.

As shown in FIGS. 23 and 24, the electrical connections, regardless of whether they are coplanar between two concentric elements or transverse between two superposed elements, can be provided with respective connection diodes serving to eliminate or to add operating modes depending on the bias voltage applied to the diode.

The invention claimed is:

1. An antenna comprising a generator and at least two metal surfaces that are mutually parallel and substantially superposed;

at least one of the surfaces being split into at least two concentric portions constituting a central portion and a strip surrounding the central portion;

said at least two portions being interconnected by one or more conductive strips or wires;

the at least two superposed surfaces being interconnected by at least one conductive wire or strip; and the at least two portions of the split surface including a portion connected to a first terminal of the generator and a portion connected to a second terminal of the generator;

this structure imparting multifunctional behavior to the antenna.

2. An antenna according to claim 1, wherein the surfaces split into two elements together provide a mode of operation of the wire-and-patch antenna type formed by the two metal surfaces taken together.

3. An antenna according to claim 1, wherein each surface split into two elements interconnected by at least one conductive strip or wire adds a new mode of operation of the coplanar wire-and-patch antenna type formed by the two separated portions.

4. An antenna according to claim 1, wherein said antenna includes an electrical feed connection connecting the first terminal of the generator/receiver to the central portion of the surface split into at least two portions, which electrical connection is formed by a wire extending perpendicularly to the two surfaces.

5. An antenna according to claim 4, wherein the electrical feed connection is formed by the central conductor of a coaxial connection which passes through the other metal surface without touching said other metal surface.

6. An antenna according to claim 4, wherein the electrical feed connection is connected to a strip connected to a central portion of the surface that is split into at least two portions.

7. An antenna according to claim 4, wherein the electrical feed connection is formed by a wire which connects the central portion of the split surface to the other surface.

8. An antenna according to claim 7, wherein the electrical feed connection is formed by a vertical wire which connects a feed strip of the central portion of the split surface to the other surface.

9. An antenna according to claim 1, wherein the conductive wire or strip connects the outer zone of the split surface to the other surface.

10. An antenna according to claim 9, wherein the wire connects the other surface to the outer zone of the second split surface.

11. An antenna according to claim 10, wherein the wire or strip connects the surface to a strip providing the connection between the two portions of the split surface.

12. An antenna according to claim 1 , further comprising:

a coplanar feed line formed by three parallel strips, a central strip being connected to the active terminal of a generator/receiver while two outer strips are connected to the ground of the generator/receiver, a central strip is connected to the central element and passes through a peripheral element without touching said peripheral element, the two outer elements of the coplanar line being connected to the peripheral element;

a first conductive connection which connects the feed strip to the central element; and a second conductive connection which connects the peripheral element to the surface.

13. An antenna according to claim 1, wherein said antenna includes a plurality of mutually parallel top plates of identical shape.

14. An antenna according to claim 1, wherein said antenna includes a plurality of top plates each split into a central element and a strip peripheral to the central element and interconnected by a ground return strip or connection, the central elements of the various plates being interconnected by wires extending a free wire, while the various peripheral strips are interconnected by wires extending a ground return wire (160).

15. An antenna according to claim 1, wherein said antenna includes a plurality of solid parallel top plates interconnected by at least one wire, and preferably via multiple connections disposed in a symmetrical arrangement.

16. An antenna according to claim 1, wherein said antenna comprises three surfaces arranged in series between two terminals of a generator/receiver.

* * * * *